US010850951B2

(12) United States Patent
Boos

(10) Patent No.: US 10,850,951 B2
(45) Date of Patent: Dec. 1, 2020

(54) MOBILE CRANE COMPRISING A BALLAST RECEIVING DEVICE AND METHOD FOR BALLASTING A MOBILE CRANE

(71) Applicant: LIEBHERR-WERK EHINGEN GMBH, Ehingen/Donau (DE)

(72) Inventor: Bernd Boos, Mehrstetten (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 0 days.

(21) Appl. No.: 16/093,419

(22) PCT Filed: May 4, 2017

(86) PCT No.: PCT/EP2017/000558

§ 371 (c)(1),
(2) Date: Oct. 12, 2018

(87) PCT Pub. No.: WO2017/190840

PCT Pub. Date: Nov. 9, 2017

(65) Prior Publication Data

US 2019/0169001 A1 Jun. 6, 2019

(30) Foreign Application Priority Data

May 4, 2016 (DE) ..... 10 2016 005 505

(51) Int. Cl.

| | |
|---|---|
| ***B66C 23/74*** | (2006.01) |
| ***B66C 13/12*** | (2006.01) |
| ***B66C 23/72*** | (2006.01) |
| *B66C 15/00* | (2006.01) |
| *B66C 23/88* | (2006.01) |

(52) U.S. Cl.

CPC ..... *B66C 23/74* (2013.01); *B66C 13/12* (2013.01); *B66C 23/72* (2013.01); *B66C 15/00* (2013.01); *B66C 23/88* (2013.01)

(58) Field of Classification Search

CPC ..... B66C 13/12; B66C 23/62; B66C 23/72; B66C 23/74; B66C 23/76; B66F 9/205; E02F 9/18; B62D 49/085

See application file for complete search history.

(56) References Cited

U.S. PATENT DOCUMENTS 3,822,791 A * 7/1974 Eiler ..... B66C 23/36 212/178
3,891,095 A * 6/1975 Symmank ..... B66C 23/74 212/178

(Continued)

FOREIGN PATENT DOCUMENTS

CN 203 855 333 U 10/2014
CN 105 347 209 A 2/2016

(Continued)

*Primary Examiner* — Michael R Mansen
*Assistant Examiner* — Juan J Campos, Jr.
(74) *Attorney, Agent, or Firm* — Dilworth & Barrese, LLP

(57) ABSTRACT

The invention relates to a mobile crane having at least one ballast receiver that is vertically adjustable via one or more ballast cylinders and having a coupling for connecting the ballast cylinder or cylinders to the energy supply of the crane, wherein the energy supply can be releasably connected to the at least one ballast cylinder via at least one coupling part.

16 Claims, 8 Drawing Sheets

(56) References Cited

U.S. PATENT DOCUMENTS

| | | | | | |
|---|---|---|---|---|---|
| 4,363,412 | A | * | 12/1982 | Patel | B66C 23/74 212/178 |
| 4,518,305 | A | * | 5/1985 | Stuhrmann | B62D 49/085 212/196 |
| 5,199,583 | A | * | 4/1993 | Weider | B66C 23/74 212/178 |
| 5,524,777 | A | * | 6/1996 | Weber | B66C 23/74 212/178 |
| 5,598,935 | A | * | 2/1997 | Harrison | B62D 49/085 180/69.1 |

FOREIGN PATENT DOCUMENTS

| | | | | | |
|---|---|---|---|---|---|
| DE | 3912868 | C1 | * | 8/1990 | B66C 23/74 |
| DE | 198 03 780 | A1 | | 7/1999 | |
| DE | 202014008661 | U1 | * | 12/2014 | B66C 23/76 |
| JP | 2009208865 | A | * | 9/2009 | |
| JP | 2010100348 | A | * | 5/2010 | |
| JP | 2012-116642 | A | | 6/2012 | |
| JP | 5284750 | B2 | * | 9/2013 | |
| WO | WO-2013056413 | A1 | * | 4/2013 | B66C 23/74 |

* cited by examiner 203
200, 201
5
7
20

10
5
220
a)
201
204
b)
200
202
20
9
c)
d)
9
e)

MOBILE CRANE COMPRISING A BALLAST RECEIVING DEVICE AND METHOD FOR BALLASTING A MOBILE CRANE

BACKGROUND OF THE INVENTION

The invention relates to a mobile crane on a wheel chassis or on a crawler chassis having at least one ballast receiver that receives ballast via one or more ballast cylinders and having a coupling for connecting the ballast cylinder or cylinders to the energy supply of the crane. The invention further relates to a method of ballasting a mobile crane.

With a mobile crane the permitted maximum weight for road travel has to be observed, on the one hand, and the supporting steelwork structure of the crane should have as high a weight as possible, on the other hand, to make sufficient stability and large payloads possible. Specific crane components are dismantled for road travel, for example, for this reason. Both the ballast receiver and the associated ballast cylinders are dismantled, for example, and are transported to the destination separately from the mobile crane.

The hydraulic cylinders (ballast cylinders) typically accommodated in the ballast reception frame or in the base ballast plate are typically required for the installation of the ballast receiver; the ballast cylinders in particular enable a raising of the ballast receiver, including the ballast plates stacked thereon, from the undercarriage to be able to fasten it to the crane slewing platform. A fixed installation of the ballast cylinders in the undercarriage is excluded for reasons of space and weight. To put the ballast cylinders into operation, they must first be connected to the hydraulic supply of the crane, which has previously taken place by a manual connection of the hydraulic lines of the mobile crane to the ballast cylinders. This oil supply can take place from the undercarriage or from the superstructure.

SUMMARY OF THE INVENTION

The object of the present invention comprises further developing such a ballast receiver for a mobile crane to enable an automated connection of the energy supply. A shortening of the setup time should in particular be achieved in those cranes in which the ballast cylinders with the ballast receiver frame are removed from the superstructure for road travel. A more efficient dismantling option should, however, also be provided for smaller cranes in which the ballast cylinders have previously remained installed at the superstructure during road travel.

This object is achieved by a mobile crane having the features herein. Starting from the previously described ballast receiver having one or more ballast cylinders, it is proposed in accordance with the invention to releasably connect the energy supply to the at least one ballast cylinder via at least one coupling part.

A particularly preferred solution comprises configuring a coupling part at the crane side for the establishing of the energy supply of the ballast receiver as travelable or as adjustable by means of at least one coupling drive. Since the height of the ballast receiver is as a rule adjusted by the ballast cylinders, i.e. said ballast receiver is to be raised from the vehicle frame or from the undercarriage, the coupling drive has to ensure at least one vertical adjustment of the crane-side coupling part. Due to the driven movement of the crane-side coupling part, it can be allowed to track a movement of at least one complementary coupling part arranged at the ballast receiver.

The coupling can be closed in an automated manner by this solution and the energy supply of the at least one ballast cylinder can be established. The drive consequently permits the automated coupling hitching by moving the crane-side coupling part in the direction of the complementary coupling part of the ballast receiver. The initial coupling can, however, also take place by the movement and by the distance of the base ballast plate covered in this process. The drive furthermore enables a tracking of the complementary coupling part on a movement of the ballast receiver, for example on a lifting movement for installation at the slewing platform. The complementary coupling part can be integrated into the ballast receiver, in particular into the base ballast plate, and/or into at least one ballast cylinder, preferably into the piston rod of the ballast cylinder.

In accordance with a preferred embodiment of the invention, the ballast receiver comprises a base ballast plate releasably arranged at a crane slewing platform. One or more ballast plates can be stacked on this base ballast plate.

The one or more ballast cylinders that are received at this base ballast plate serve the vertical adjustment of this base ballast plate that is typically placed on the vehicle frame for installation purposes. The integration of these ballast cylinders in ballast receiver pipes is also conceivable. The base ballast plate furthermore comprises at least one complementary coupling part for connecting to the supply line from the undercarriage of the mobile crane. This complementary coupling part forms the counterpiece for the crane-side coupling part to establish the energy supply.

The coupling drive for the crane-side coupling part can be a piston-in-cylinder unit. The crane-side coupling part is fastened to the travelable part of the drive, ideally to the piston rod or to the free end of the piston rod. The crane-side coupling part can be adjusted in dependence on the orientation of the drive by the actuation of the piston rod, expediently in the direction of the ballast receiver and/or of the slewing platform. An extension movement of the piston rod in the vertical direction or almost in the vertical direction is preferred. Even if a coupling arrangement at the piston rod is preferred, the invention does not prohibit an arrangement of the coupling at the cylinder if the latter forms the drive part movable relative to the crane. In this case, a bottom-side installation of the coupling part at the cylinder has proven sensible.

In accordance with a preferred embodiment, the crane-side coupling part and/or the coupling drive are received at the vehicle frame or at the undercarriage. The coupling drive or the crane-side coupling part can, for example, likewise be let into the undercarriage or into the vehicle frame or, in the case of the crane-side coupling part, can be let into it by a retraction movement of the drive. A reception of the coupling drive in a cut-out of the vehicle frame or of the undercarriage is also conceivable, such as in the region of the wheel well or of the fastening of a support cylinder or a support pillar. In accordance with another preferred embodiment variant, the crane-side coupling part and/or coupling drive can be arranged at the superstructure.

The coupling system used is particularly preferably a quick-coupling system, in particular a pneumatic or hydraulic quick-coupling system. Such systems are already known and are sold by the applicant, for example, under the name Likufix.

In accordance with a further advantageous embodiment of the invention, different reception positions for the ballast receiver or for the base ballast plate can be provided at the slewing platform, i.e. the slewing platform provides different reception means for hooking in the ballast receiver. The flexible reception position thereby arising has the advantage that the ballasting of the crane with different ballast radii is made possible and thereby an ideal adaptation of the ballasting of the crane can take place in dependence on the intended deployment.

It can in particular be sensible in this connection that the ballast receiver or the base ballast plate comprises a plurality of complementary coupling parts that are fastened offset to one another at different slewing radii of the slewing platform or are let into it. The arrangement of a plurality of complementary coupling parts then also permits an establishing of the coupling connection when the base ballast plate or ballast receiver is installed in different positions at the crane slewing platform.

The separately traveled ballast receiver or base ballast place is initially raised onto the chassis of the mobile crane for the setup of the crane at a construction site. To already ensure a precisely positioned placement of the ballast receiver or of the base ballast plate on the mobile crane for a fast connection of the energy supply, one or more centering elements are preferably provided on the chassis to facilitate an exact-fit positioning of the ballast receiver or of the base ballast plate on the chassis. Such centering elements can be configured, for example, in the form of a positioning cone that projects into corresponding cut-outs of the ballast receiver or of the base ballast plate on a correct positioning.

In accordance with an optional embodiment of the invention, the crane-side coupling part can be supported at the crane beside the vertical adjustment movable about at least one further axis. The crane-side coupling part is preferably movable along the at least one further axis by a suitable drive. In principle, a support with sufficient play along the at least one axis can be sufficient to facilitate the coupling hitching. Degrees of freedom in the direction of travel or transversely to the direction of travel are conceivable, for example.

An alternative preferred embodiment comprises at least one crane-side coupling part being arranged at the undercarriage and at least one crane-side coupling part being arranged at the superstructure so that the at least one ballast cylinder is respectively connectable to one of the two coupling parts or to both coupling parts. No tracking movement of the energy supply takes place here on the raising of the base ballast plate. The energy supply first takes place via the coupling part at the undercarriage. After the coupling of the ballast to the superstructure, preferably to the slewing platform, the energy supply of the ballast cylinder takes place solely or additionally via the coupling part at the superstructure.

A further optional embodiment of the invention provides that the ballast receiver or the base ballast plate and/or the crane chassis is/are equipped with at least one further cylinder for tightening the ballast plate. This is in particular sensible to latch the ballast plates on the ballast receiver or on the base ballast plate. This cylinder can, for example, also be fed from the undercarriage via the energy supply provided by coupling.

In addition to the mobile crane, the present invention additionally relates to a method of ballasting a crane, wherein a mobile crane in accordance with the present invention is made use of. The performed method is characterized by the following method steps:

lifting the ballast receiver or the base ballast plate onto the vehicle frame of the crane;

establishing the energy supply of the one or more ballast cylinders via the coupling;

wherein the ballast cylinder is actuated and the crane-side coupling part is simultaneously tracked by means of the coupling drive on a relative movement of the complementary coupling part arranged at the ballast receiver and/or at the ballast cylinder; or wherein a first energy supply is already established on the lifting of the ballast receiver or of the base ballast plate onto the vehicle frame; and wherein a second energy supply is established on the connecting of the ballast receiver to the slewing platform by actuating the ballast cylinders.

A secured coupling closure and thus a continuous energy supply of the ballast cylinders even on a raising of the ballast receiver or of the base ballast plate are achieved by the optionally synchronized tracking movement of the crane-side coupling part.

Provision can be made in a subsequent step that once the ballast receiver or the base ballast plate have been installed on the crane slewing platform, the ballast cylinders are first retracted and the coupling is subsequently released. After the release of the coupling, in particular the coupling drive is actuated to remove the crane-side coupling part from the danger zone of the base ballast plate or of the ballast receiver so that it does not represent any obstacle on a slewing movement of the crane slewing platform.

A tracking movement can take place as soon as an actuation of the ballast cylinder occurs, i.e. the complementary coupling part is moved. This is done on an integration of the coupling part into the base ballast plate on each movement of the ballast.

Provision can be made in accordance with an advantageous embodiment of the method that the ballast or the ballast receiver is raised by first extending the ballast cylinders without a relative movement of the complementary ballast-side coupling part. This is possible when the ballast-side complementary coupling part is, for example, integrated into one of the ballast cylinders, preferably into the piston rod, or at a comparable point that is fixed relative to the undercarriage during the lifting of the ballast. When lifting the ballast, there is thus no relative movement of the ballast-side coupling part relative to the undercarriage or the crane-side coupling part. A tracking movement is only necessary on the following retraction of the ballast cylinder, i.e. after an installation of the ballast receiver to the slewing platform has taken place.

In accordance with an alternative embodiment, the ballast cylinder or cylinders is/are extended and installed at the slewing platform. The ballast is raised by the subsequent retraction of the ballast cylinders and the crane-side coupling part tracks the now moving complementary coupling part. The procedure works when the complementary coupling part is accommodated in at least one of the ballast cylinders.

A further possibility for the energy supply of the ballast cylinders could also be given in that a crane-side coupling part is provided both at the undercarriage and at the slewing platform and that the energy supply is provided by it in dependence on the location of the ballast receiver. A tracking of the coupling part could then be dispensed with. The energy supply takes place, for example, at the start by a point relative to the undercarriage fixed to the piston rod or to a comparable fixed point when the ballast is raised. No tracking movement of the energy supply takes place on the raising of the base ballast plate. After the coupling of the ballast to the slewing platform, the energy supply of the ballast cylinders takes place via quick-couplings at the slewing platform. The first connection of the ballast cylinders to a crane-side coupling of the undercarriage can then be released and the ballast cylinders are retracted.

In addition to the method in accordance with the invention, the present invention moreover relates to a control for a crane in accordance with the present invention. The control is configured such that it synchronizes a movement of the ballast cylinders and/or of the ballast receiver with an actuation of the coupling drive to have the crane-side coupling part track a movement of the ballast receiver or of the base ballast plate. The control is preferably configured such that it carries out the method steps in accordance with the present invention.

BRIEF DESCRIPTION OF THE DRAWINGS

Further advantages and properties of the invention will be explained in more detail in the following with reference to an embodiment shown in the drawings. There are shown.

DESCRIPTION OF THE PREFERRED EMBODIMENTS

Figure 1:
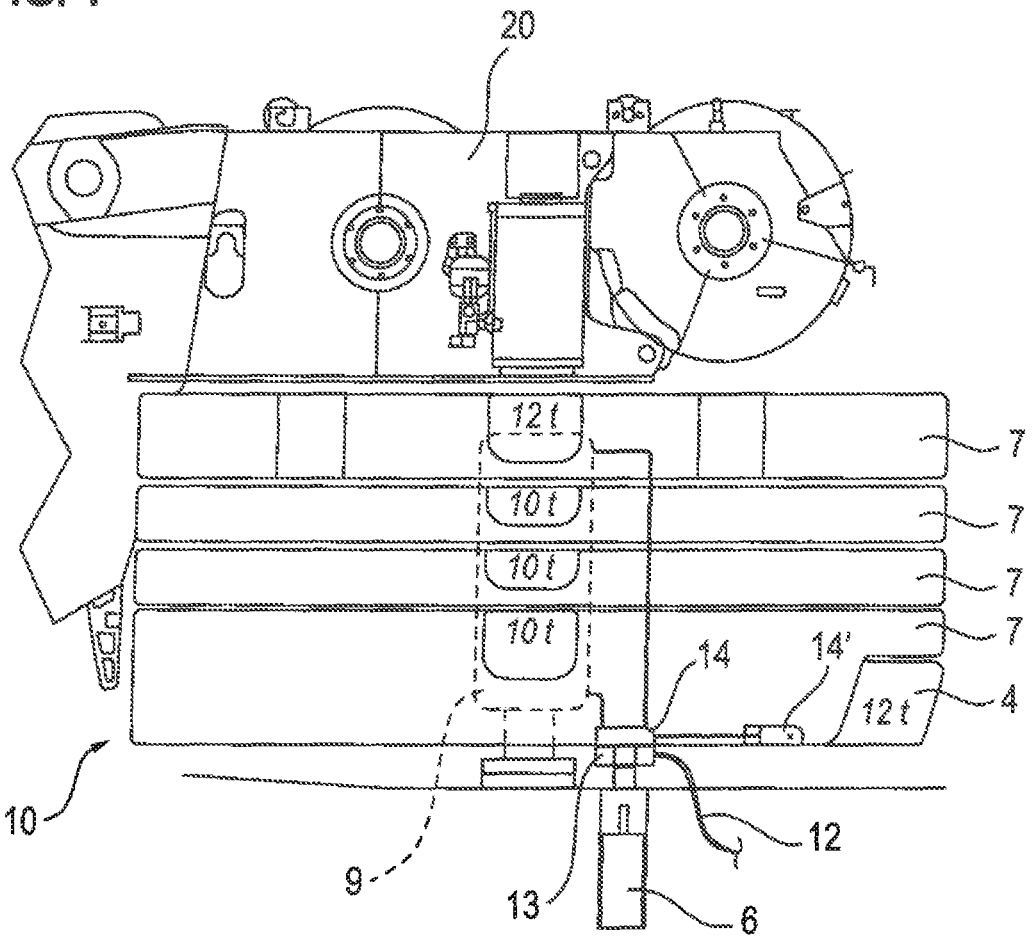
FIG. 1: a detailed view of the crane slewing platform of the mobile crane in accordance with the invention with an installed ballast receiver.

A side view of the crane slewing platform 20 with ballast of a mobile crane in accordance with the invention is shown in FIG. 1. The invention starts from a ballast receiver 10 releasably installable at the crane slewing platform 20 of a crane. This ballast receiver 10 comprises a base ballast plate 4 on which individual ballast plates 7 can be stacked in dependence on the required ballast weight. The base ballast plate 4 that is typically placed on the vehicle frame 5 autonomously or by means of an auxiliary crane 8 on the setup of the crane on the construction site should be raised so far via its own ballast cylinder 9 until it can ultimately be installed at the crane slewing platform 20 of the mobile crane. Two ballast cylinders 9 are typically provided.

Figure 2:
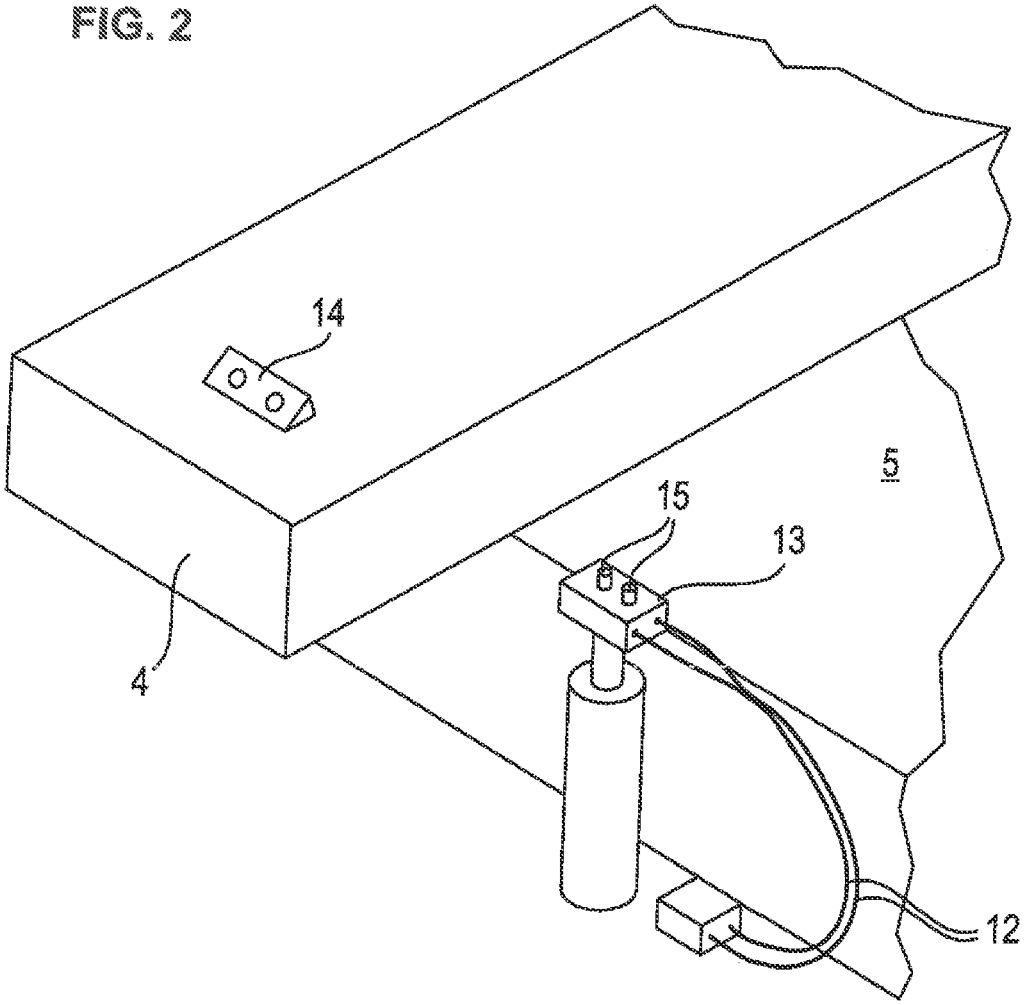
FIG. 2: a detailed representation of the coupling drive.

To provide the required hydraulic supply of the ballast cylinders 9, they must first be connected to the hydraulic supply 12 of the crane undercarriage 5. This should, where possible, take place by a quick coupling known per se that comprises, on the one hand, a crane-side coupling part 13 and a ballast-side coupling part 14. Reference is made by way of example to the detailed representation of FIG. 2. In this respect, a crane-side coupling part 13 is provided that has the corresponding connection parts 15, that engages into a complementary coupling part 14 let in the base ballast plate 4, and that thereby permits a fully automatic establishing of a hydraulic connection for the supply of the ballast cylinders. The ballast-side coupling part 14 is preferably arranged on the lower side of the base ballast plate 4.

Since the base ballast plate 4 is raised from the vehicle frame 5 on the actuation of the ballast cylinders 9, it must be ensured that the crane-side coupling part 13 also tracks this travel movement. A coupling drive 6 is provided for this purpose that is configured as a piston-in-cylinder unit 6 in the embodiment shown. The cylinder is here installed at the vehicle frame 5; the crane-side coupling part 13 is received at the free rod end. The crane-side coupling part 13 can be moved upwardly in the vertical direction by an extension movement of the piston rod and can thereby track a movement of the base ballast plate 4 on an actuation of the ballast cylinders 9.

Figure 4:
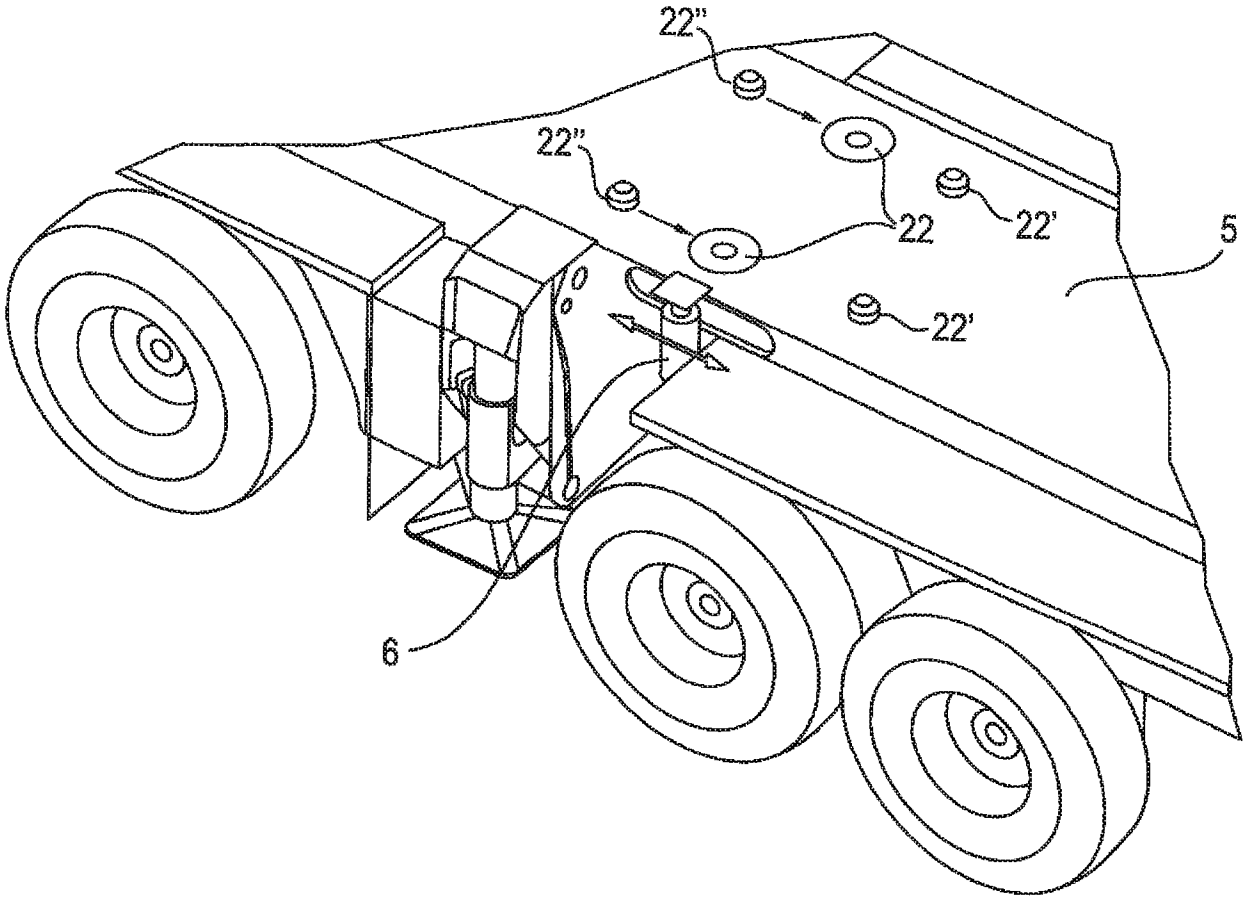
FIG. 4: a detailed representation of the crane chassis of the mobile crane in accordance with the invention.

A possible installation location of the coupling drive 6 can be seen from the representation in accordance with FIG. 4. The vehicle frame 5 typically has margin-side recesses for receiving lateral support pillars 21. The frame region of the rearmost or middle support pillar provides sufficient space for the reception of the coupling drive 6. The support of the cylinder 6 can permit a movement of the drive 6 in the direction of travel to have a certain play for the coupling hitching to implement different ballast radii.

It can likewise be seen in FIG. 4 that one or more ballast centering pins 22, 22', 22" are provided on the surface of the vehicle frame 5 that are arranged offset from the axis of rotation of the slewing platform 20 in the direction of travel. These centering pins serve the exact positioning of the base ballast plate 4 on the vehicle frame, with at least one pin 22 projecting into the matching recess of the lower side of the base ballast plate with a correct location.

Figure 3:
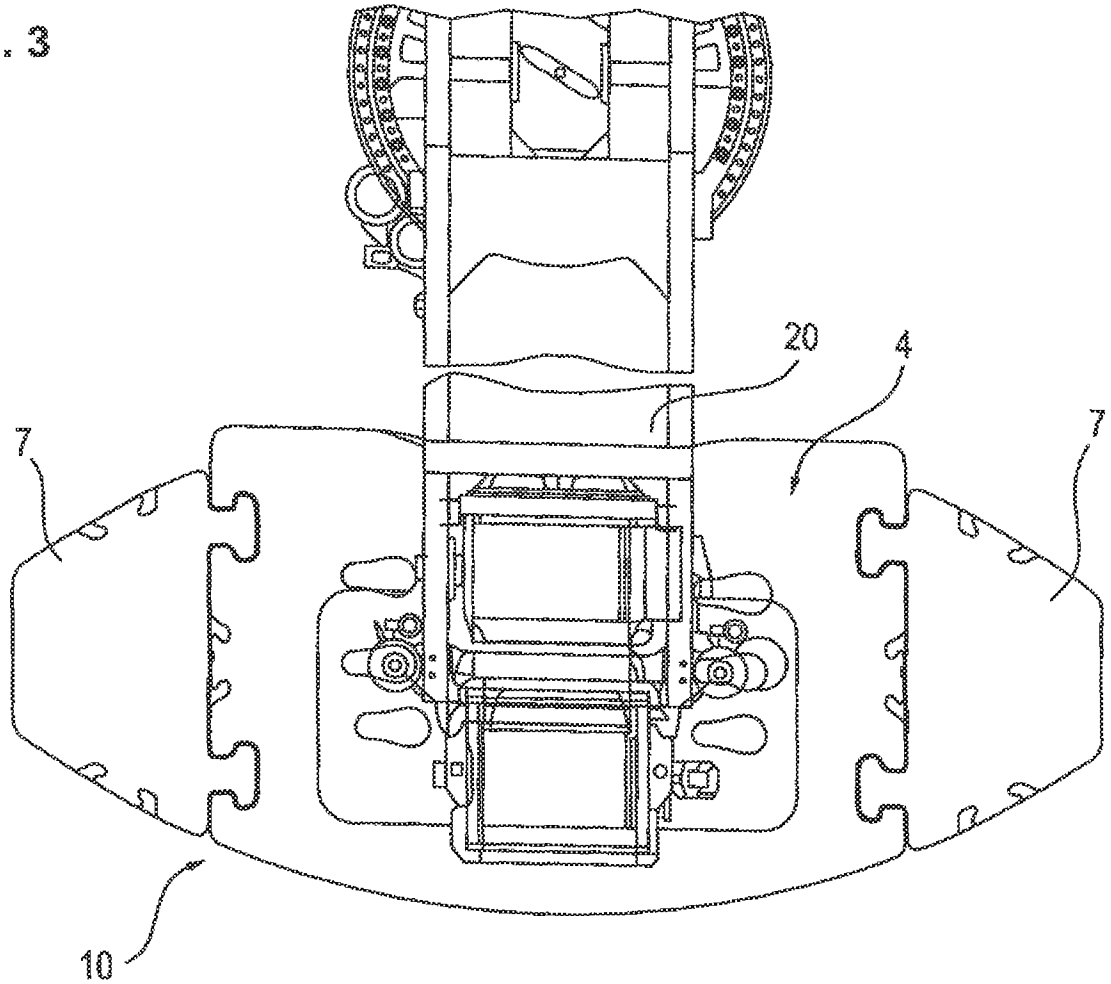
FIG. 3: a plan view of the slewing platform of FIG. 1.

Different pins 22, 22', 22" serve the positioning of the base ballast plate 4 in different installation positions of the slewing platform 20 with different ballast radii. For this purpose, the slewing platform 20 provides different suspension points for the base ballast plate 4, whereby it can be installed at a different distance from the slewing axis of the slewing platform (FIG. 3). Since the distance of the crane-side coupling part 13 from the axis of rotation of the slewing platform 20 is almost fixed, a plurality of complementary 14, 14' having different distances from the support point at the slewing platform 20 are therefore provided in or at the base ballast plate 4. Depending on the installation position, exactly one coupling part 14, 14' can be connected to the crane-side part 13.

Figure 5:
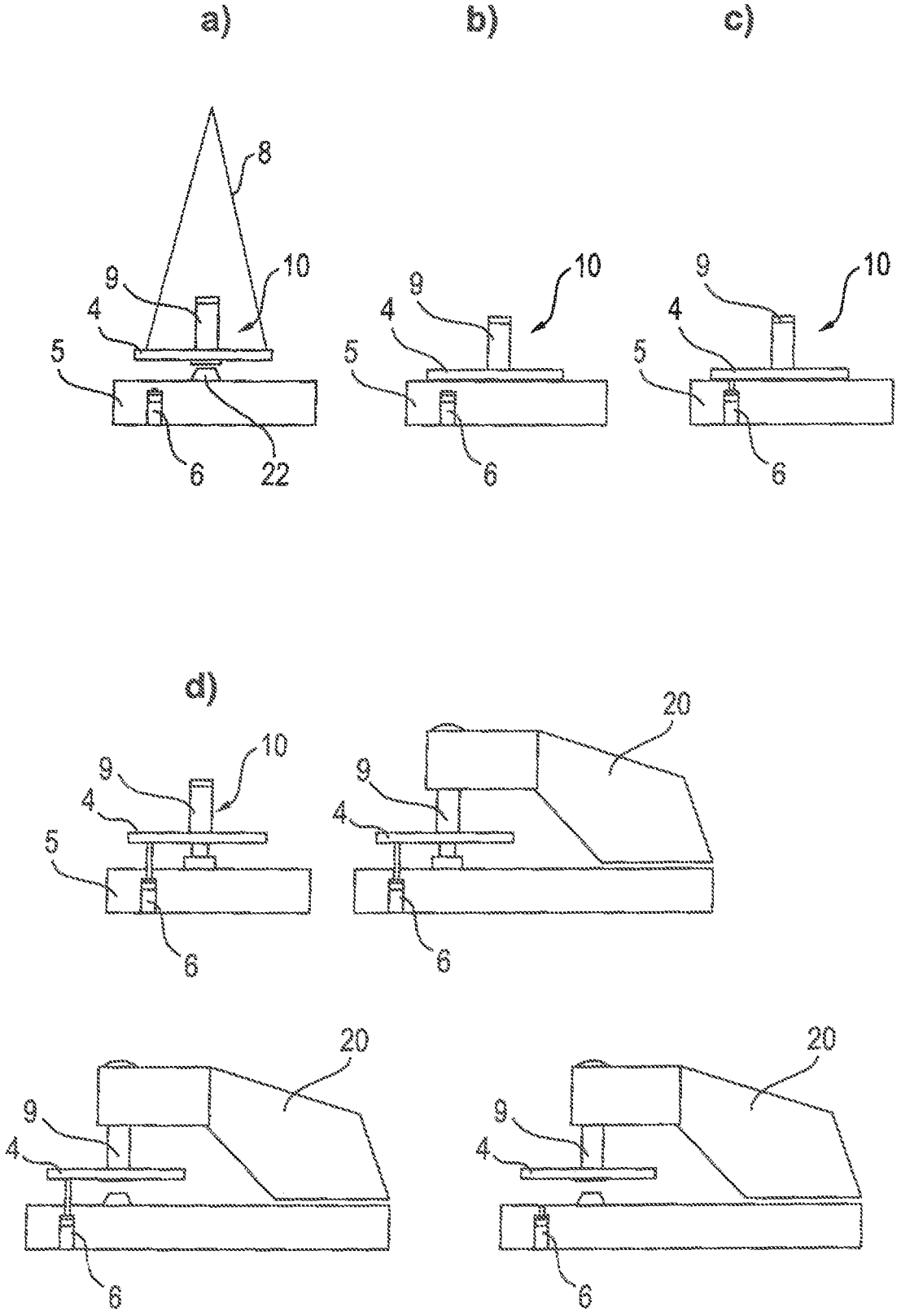
FIG. 5: a chronological representation of the individual method steps of the method in accordance with the invention.

The individual method steps for the ballasting of the mobile crane will be explained in the following with reference to the different representations of FIG. 5. In a first step in accordance with FIG. 5*a*, the base ballast plate 4 is first placed on the vehicle frame 5 with the aid of a lifting means 8. The centering pin 22 that ensures a centered and exactly fitting placement of the base ballast plate 4 can be recognized here. The piston rod of the coupling drive 6 is completely retracted and consequently does not project beyond the upper edge of the vehicle frame.

After the placement of the base ballast plate 4 (FIG. 5*b*), it can be provided with the required ballast plates that are stacked on one another (not shown) on the surface of the base ballast plate 4.

In the next method step in accordance with FIG. 5*c*, the energy supply 12 of the ballast cylinders 9 is ensured in that the piston rod of the coupling drive 6 is extended so far until the crane-side coupling part 13 engages into the complementary counterpiece 14 of the coupling within the base ballast plate 4. After a successful establishing of the energy supply, the ballast cylinders 9 are actuated and the base ballast plate 4 is raised from the vehicle frame 5 (FIG. 5*d*).

It is ensured by the crane control that the piston-in-cylinder unit of the coupling drive 6 is actuated synchronized with the ballasting movement of the ballast cylinders 9. In detail, the piston rod of the coupling drive 6 is extended and thus tracks the vertical adjustment of the base ballast plate 4. This takes place for so long until the ballast base plate 4 has been traveled so far upwardly until it can be installed on the slewing platform 20.

After the positioning and installation of the base ballast plate 4 on the slewing platform 20, the ballast cylinders 9 can be retracted again. Subsequently, the energy supply can also be released in that the coupling drive 6 or the piston rod is retracted. The slewing movement of the slewing platform 20 is only hereby released. The control in particular provides a safety measure that only releases a slewing movement of the slewing platform 20 until the coupling drive 6 has been completely retracted.

Figure 6:
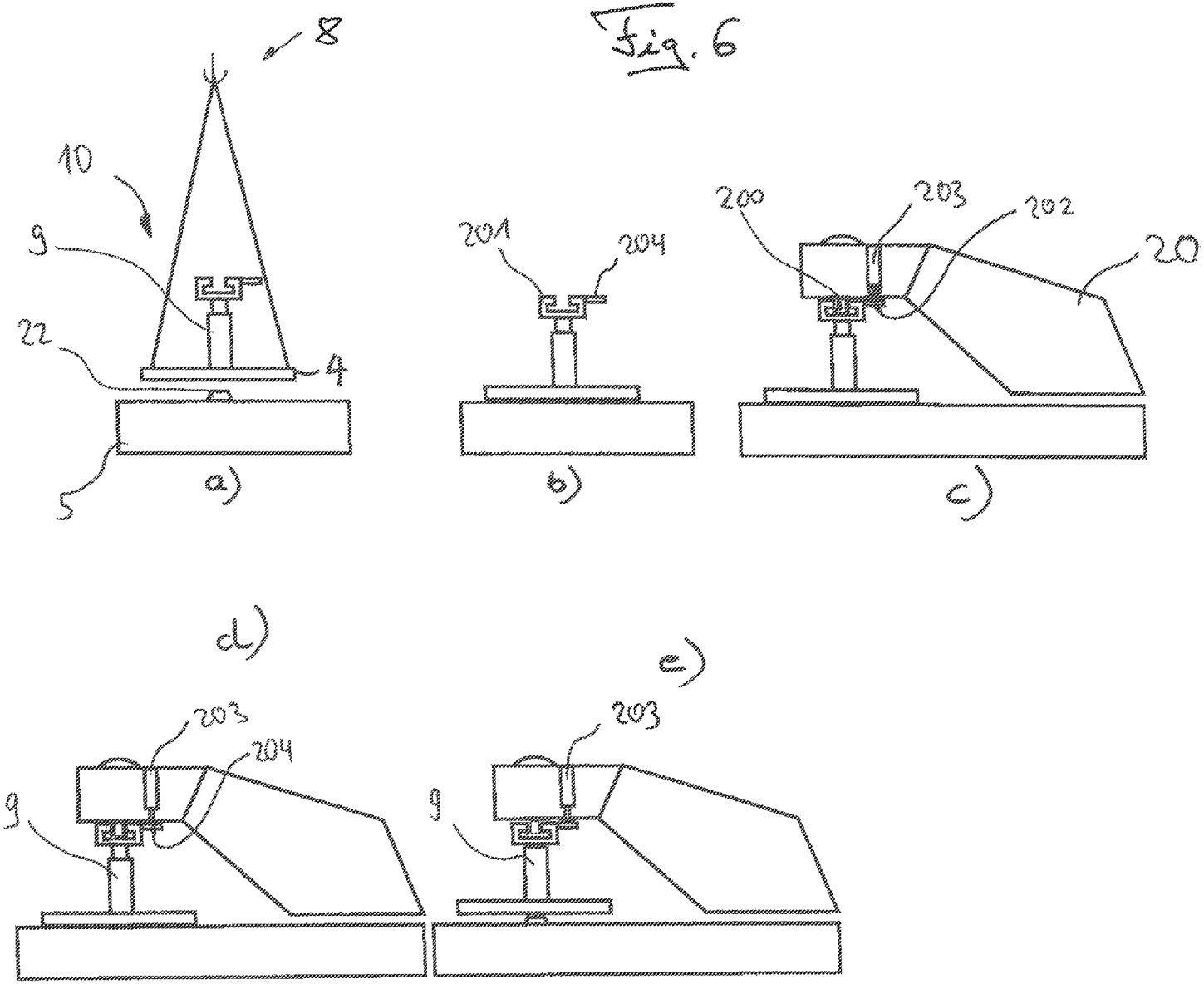
FIG. 6: a chronological representation of the individual method steps of the method in accordance with the invention in accordance with an alternative embodiment variant.
Figure 7:
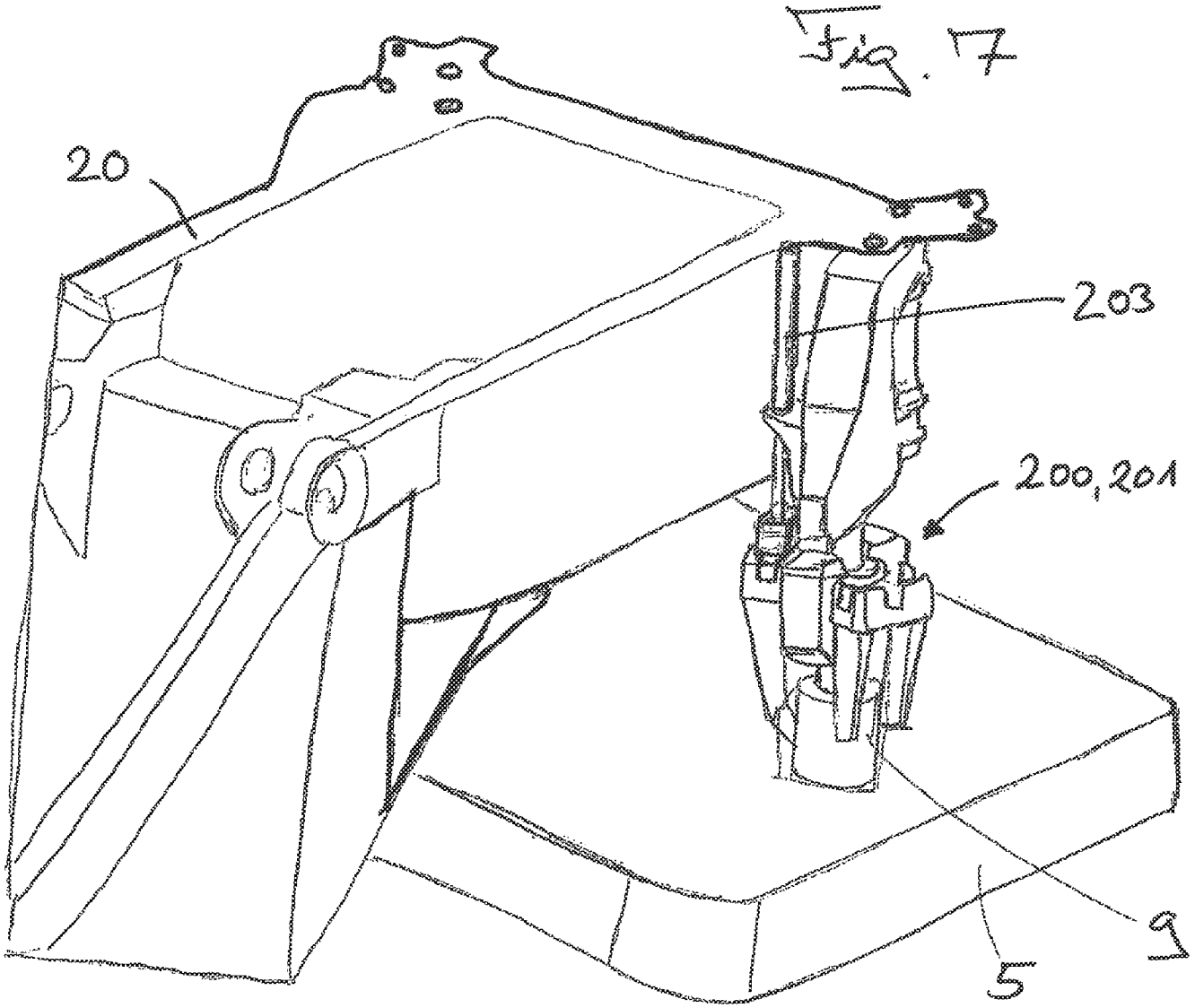
FIG. 7: a perspective view of a part of the superstructure with ballast receiver.

An alternative embodiment variant of the invention is shown in FIGS. 6 and 7. The energy supply here takes place from the superstructure, i.e. from the crane slewing platform 20. The vehicle frame 5 has the ballast centering pins 22. A load suspension means places the base ballast plate 4 on the ballast centering pins 22. This can take place via an auxiliary crane 8 or via the crane itself. The ballast receiver 10 can also comprise the base ballast plate 4, the ballast plates 7, and the ballast cylinders in this embodiment.

FIG. 6*c* shows how the superstructure (crane slewing platform 20) is inwardly pivoted and how the overlap between the connection means 200 at the superstructure side and the connection means 201 at the ballast receiver 10 is established. The ballast receiver 10 does not yet have any connection to an energy supply and is thus still passive.

The energetic and technical control connection takes place by the extension of the coupling element 22 at the superstructure side via the tracking 205 in the direction of the coupling element 204 at the ballast receiver 10. The connection means 210 lie at the connection means at the superstructure side by retracting the ballast cylinders 9 and on a further retraction, lifts the ballast receiver 10 from the vehicle frame 5 until the ballast receiver 10 is pressed onto the crane slewing platform 20. Where required, a mechanical connection can now be established.

The previously described embodiment is shown in a simplified perspective view in FIG. 7.

Figure 8:
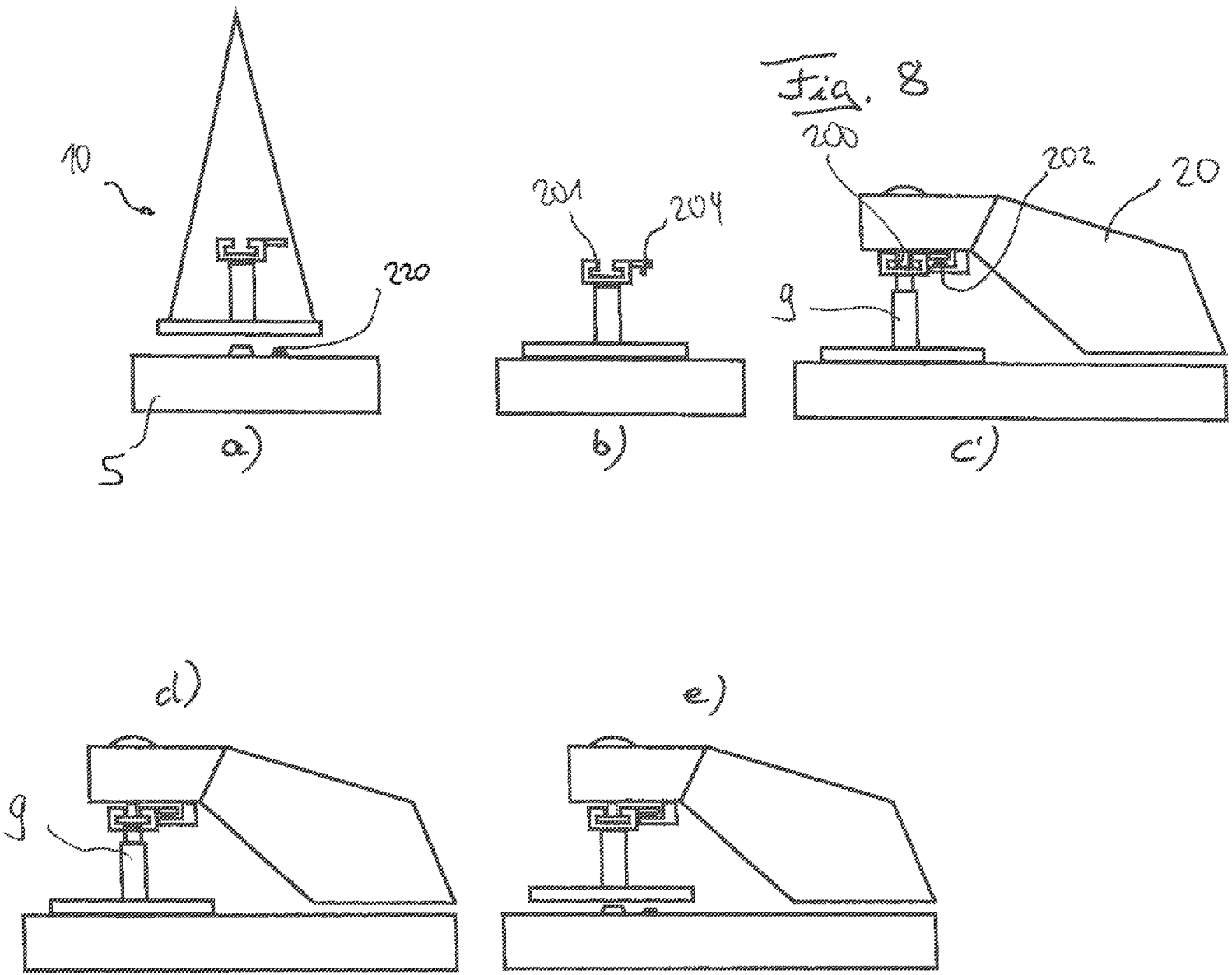
FIG. 8: a chronological representation of the individual method steps of the method in accordance with the invention in accordance with a further alternative embodiment variant.

A further alternative embodiment of the invention is shown in FIG. 8. The energy supply takes place alternately here and without a tracking from the vehicle frame of the undercarriage and from the crane slewing platform. The ballast receiver 10 is raised onto the vehicle frame here. A hydraulic connection is in this respect established from the vehicle frame 5 to the ballast receiver 10 via a quick coupling 220.

As also in the previously described solution, the inward slewing of the crane slewing platform 20 subsequently takes place; there is still no connection (either mechanical or hydraulic) between the crane slewing platform 20 and the ballast receiver 10.

The ballast cylinders subsequently retract and in so doing establish the mechanical connection between the crane slewing platform 20 and the ballast receiver 10. The hydraulic and electric connection between the crane slewing platform 20 and the ballast receiver 10 is here established via further quick couplings 202, 204. The ballast receiver 10 is supplied in this position both from the vehicle frame 5 and from the crane slewing platform (cf. FIG. 8*d*).

On a further retraction of the ballast cylinders 9, the ballast receiver 10 releases from the vehicle frame 5 and the quick coupling 220 is released from the counter-connection element at the ballast receiver 10. The quick couplings are self-closing couplings if no counter-connection element is coupled.

The invention claimed is:

1. A mobile crane having at least one ballast receiver that is vertically adjustable via at least one ballast cylinder and said ballast receiver having a coupling for connecting the at least one ballast cylinder to an energy supply of the crane, wherein the energy supply is releasably connected to the at least one ballast cylinder via said coupling which comprises a first coupling part is vertically adjustable via at least one coupling drive to track a movement of at least one complementary second coupling part arranged at the ballast receiver.

2. A mobile crane in accordance with claim 1, wherein the at least one ballast receiver comprises a base ballast plate releasably arranged at a crane slewing platform, with the base ballast plate having the at least one ballast cylinder for a vertical adjustment of the base ballast plate for installation at the crane slewing platform; and with said at least one second complementary coupling part being received by the base ballast plate or being inserted into the base ballast plate.

3. A mobile crane in accordance with claim 1, wherein said at least one coupling drive for the first coupling part is a piston-in-cylinder unit and the first coupling part is received at a bottom cylinder side or at a free piston end.

4. A mobile crane in accordance with claim 1, wherein the first coupling part and/or said at least one coupling drive is/are installed at a vehicle frame or an undercarriage, or is/are inserted into or supported in a cut-out of the vehicle frame/undercarriage.

5. A mobile crane in accordance with claim 4, wherein the first coupling part and/or said at least one coupling drive is/are installed, or inserted or supported in a region of a support cylinder installed at the vehicle frame/undercarriage.

6. A mobile crane in accordance with claim 1, wherein at least one of the coupling part and the coupling drive is arranged at a superstructure.

7. A mobile crane in accordance with claim 1, wherein the first coupling part is supported beside a vertical adjustment movable about a further axis, with travel movement taking place manually or by a suitable drive.

8. A mobile crane in accordance with claim 1, wherein the first coupling part is arranged at an undercarriage and comprising an additional first coupling part arranged at a superstructure such that the at least one ballast cylinder is respectively connectable to one of the two first coupling parts or to both said first coupling parts.

9. A mobile crane in accordance with claim 1, wherein the coupling is a quick coupling system.

10. A mobile crane in accordance with claim 9, wherein the quick coupling system is a pneumatic or hydraulic quick coupling system.

11. A mobile crane in accordance with claim 1, wherein the at least one ballast receiver having a base ballast plate and/or a crane chassis has at least one cylinder for tightening ballast plates on latching, with the at least one cylinder being supplied with energy via the coupling.

12. A method of balancing a crane in accordance with claim 1, comprising the following steps:

lifting the at least one ballast receiver or a base ballast plate onto a vehicle frame of the crane;

establishing the energy supply of the at least one ballast cylinder via the coupling; wherein the at least one ballast cylinder is actuated and the first coupling part is simultaneously tracked by the at least one coupling drive on a relative movement of the second coupling part arranged at the at least one ballast receiver and/or at the at least one ballast cylinder; or said energy supply is first established on lifting of the at least one ballast receiver or the base ballast plate onto the vehicle frame; and said energy supply is then further established on connecting the at least one ballast receiver to a slewing platform, by actuating the at least one ballast cylinder.

13. A method in accordance with claim 12, wherein at least one of a retraction of the at least one ballast cylinder, a release of the coupling, and a retraction of the first coupling part is provided in a subsequent method step.

14. A method in accordance with claim 12, wherein the ballast plate or the at least one ballast receiver is lifted by expanding the at least one ballast cylinder without a relative movement of the second coupling part and a tracking movement of the first coupling part only takes place on the retraction of the at least one ballast cylinder with an already performed installation of the at least one ballast receiver at the slewing platform.

15. A method in accordance with claim 12, wherein the at least one ballast cylinder is extended and installed at the slewing platform; and on subsequent retraction of the at least one ballast cylinder, the ballast plate or the at least one ballast receiver is raised with a simultaneous tracking of the first coupling part.

16. A control for a crane in accordance with claim 1 that provides an actuation of said at least one coupling drive synchronized with the movement of the at least one ballast cylinder and/or the at least one ballast receiver to have the first coupling part track a movement of the second coupling part.

* * * * *